United States Patent [19]

Meister et al.

[11] Patent Number: 4,611,927

[45] Date of Patent: Sep. 16, 1986

[54] ELECTRONIC TIMEPIECE HAVING MEANS FOR CORRECTING THE SECONDS INDICATION

[75] Inventors: Pierre-André Meister, Bienne; Daniel Koch, Crémines, both of Switzerland

[73] Assignee: ETA SA Fabriques d'Ebauches, Granges, Switzerland

[21] Appl. No.: 761,460

[22] Filed: Aug. 1, 1985

[30] Foreign Application Priority Data

Aug. 14, 1984 [CH] Switzerland ..... 3895/84

[51] Int. Cl.[4] ..... G04C 9/00

[52] U.S. Cl. ..... 368/188

[58] Field of Search ..... 368/69–70, 368/185, 187–188, 321

[56] References Cited

U.S. PATENT DOCUMENTS

| | | | |
|---|---|---|---|
| 4,192,134 | 3/1980 | Yoshida | 368/188 X |
| 4,222,010 | 9/1980 | Meisner et al. | 368/188 X |
| 4,245,338 | 1/1981 | Sekiya et al. | 368/188 |
| 4,257,114 | 3/1981 | Sekiya et al. | 368/188 X |
| 4,270,194 | 5/1981 | Morokawa et al. | 368/73 |
| 4,348,753 | 9/1982 | Werner et al. | 368/188 |
| 4,365,898 | 12/1982 | Wakai | 368/187 |
| 4,367,958 | 1/1983 | Kawahara et al. | 368/188 |

*Primary Examiner*—Vit W. Miska

*Attorney, Agent, or Firm*—Pollock, Vande Sande & Priddy

[57] ABSTRACT

A timepiece, able to indicate at least the hours, minutes and seconds, having a rotary stem movable into three axial positions: a stable neutral position in which the timepiece operates normally, a stable outer position and an unstable inner position. When the stem is pulled to the outer position the timepiece switches from the normal operating mode to a correction mode in which it is possible either to correct the minutes indication by rotating the stem slowly, or to perform a change of the hours indication done by rotating it rapidly.

Whenever the stem is simply pulled out, or is pulled out followed by a correction of the minutes indication, and is then returned to the neutral position, the timepiece switches automatically and for a set maximum time, e.g. one minute, to a transitory mode in which it is possible to reset the seconds to zero and, at the same time, to cause a return to the normal operating mode by pushing in the stem. If after a set time, no pressure has been exerted, the timepiece resumes automatically normal operation. No transitory mode is provided when only a change of the hours indication is performed.

13 Claims, 7 Drawing Figures

ELECTRONIC TIMEPIECE HAVING MEANS FOR CORRECTING THE SECONDS INDICATION

FIELD OF THE INVENTION

This invention relates to an electronic timepiece able to indicate at least the hours, minutes and seconds and having means for making a fine time setting, i.e. to correct the seconds indication.

PRIOR ART

Electronic timepieces and more particularly analogue or digital watches exist in which the display of the seconds is automatically reset to zero when switching from the normal operating state to a correction mode in which it is possible to modify the indication of the minutes with or without that of the hours. Timepieces also exist in which this zero-resetting operation is performed upon restarting the timepiece, when returning to normal operation. In this case, there are two possibilities: either the zero resetting operation is performed only if a modification of the minutes indication has indeed taken place, or it is systematic.

Such timepieces have at least one common drawback: there is always a risk that the user might unwittingly lose the exact time. This will occur for instance if he possesses a watch having a stem which, when pulled out, enables correction of the minutes or some other information, such as the date or the hours, depending on whether it is rotated in one direction or the other or at different speeds, and if he accidentally changes the minutes when he only wished to modify the other information.

In other known watches, it is possible to perform a rough time setting, i.e. an adjustment of the minutes without altering the seconds display which keeps progressing normally during correction, and also to reset the seconds to zero, e.g. on hearing a radio time signal, without having to adjust the minutes first or even to put the watch in a mode in which this adjustment can be made.

Unfortunately, these latter watches, unlike many of those first described, always have several control members made up of either push-buttons only or of a stem and one or more push-buttons, and quite often one of these control members has no other function than to control the fine time setting.

The current trend is to reduce to a minimum the number of these control members and, whenever possible, to use only a rotary stem having two or more axial positions, even with watches having many functions. This single stem concept results in a watch which is more attractive and which requires less complicated and more intuitive handling since it is akin to the mechanical watch. Furthermore, such a watch is easier to make and gives rise to fewer water-resistance problems.

SUMMARY OF THE INVENTION

A main object of the invention is to provide a timepiece which, although it preferably has only one control member, enables the user, selectively either to correct the minutes, to correct the seconds, or to adjust both for a complete time setting.

Another object of the invention is to so design a timepiece that there is no or at least very lettle likelihood for the user unwittingly to lose the exact time once he has it.

To these ends the invention provides a timepiece which comprises a time base for generating a standard frequency signal, a frequency dividing circuit coupled to the time base for generating time pulses, a display unit able to indicate at least the minutes and the seconds in response to the time pulses, a manual control member and a correction circuit which, when the control member is actuated in a first way, causes the timepiece to switch from a normal operating mode to a correction mode in which the minutes indication can be corrected by actuating the control member in a second way, wherein the correction circuit comprises a control circuit for resetting the seconds to zero which (a), in the case where the control member has only been actuated in the first way and in the case where the control member has successively been actuated in both the first and second ways, enables the timepiece to be put in a transitory zero-seconds resetting mode for a set maximum period, e.g. about one minute, from the moment the timepiece ceases to be in the correction mode, and which (b) is arranged (i) instantaneously to act on the display unit so that the seconds indication is reset to zero and to cause the timepiece to switch back to the normal operating mode when the control member is actuated in a third way before the end of said period, and (ii) to cause the timepiece only to switch back to the normal operating mode at the end of said period if the control member has not been actuated before.

Preferably, the timepiece according to the invention is so designed that normal progression of the seconds indication is not interrupted when the timepiece is in the correction mode, nor when it is in the transitory zero-seconds resetting mode, as long as the control member is not actuated in the third way.

The timepiece will of course always indicate the hours too. The correction circuit can thus also be designed to enable correction of this indication alone by actuating the control member in a fourth way when the timepiece is in the correction mode. In this case, it is preferred that the correction circuit be arranged to cause the timepiece to switch back directly from the correction mode to the normal operating mode, when only the hours indication has been altered. The same applies if the timepiece is designed to correct both the minutes and the hours by actuation of the control member in the second way and if the fourth way is reserved for other information, e.g. a date.

The control member may consist of a rotatable stem axially movable between at least three positions: a stable neutral position, a stable outer position and an unstable inner position. The first, second, third and fourth ways of actuating the control member may then consist, respectively, in moving the stem from the neutral position to the outer position, in rotating it slowly, in moving it temporarily from the neutral position to the inner position and in turning it rapidly, the timepiece switching back from the correction mode to the normal operating mode when the stem switches from the outer position to the neutral position.

BRIEF DESCRIPTION OF THE DRAWINGS

In the accompanying drawings, given by way of example.

DETAILED DESCRIPTION

Figure 1:
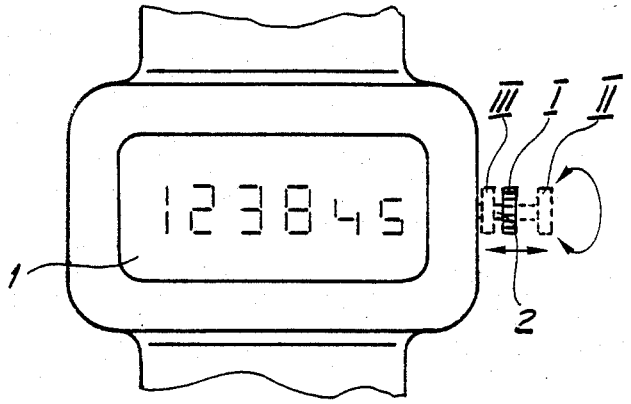
FIG. 1 is a diagrammatic front view of a digital watch according to the invention.

For the sake of simplicity, it will be assumed that the watch shown in FIG. 1, which is provided with a six-character electro-optic display arrangement 1, is only intended to indicate simultaneously and permanently the hours, the minutes and the seconds, to the exclusion of other functions such as calendar, alarm and chronograph functions. On the other hand, it enables the user to modify the hour alone according to the time zone in which he happens to be.

The watch has a single control member consisting of a rotatable stem 2 which may be moved axially between three positions, i.e. a stable neutral position I, corresponding to normal operation of the watch, a stable outer position II and an unstable inner position III in which a return spring permanently tends to move the stem back to its normal position I.

Moving stem 2 from neutral position I to outer position II causes the watch to switch to the hours and minutes correction mode. While in this mode the display of the hours and minutes continues to progress normally and flashes, at a frequency of e.g. 1 Hz, as long as stem 2 is not subjected to rotation. In this correction mode, it is possible to perform either a rough time setting, i.e. a modification of the indication of the minutes and possibly, as a result, of the hours, or a modification of the hours indication alone. It is of course also possible to combine these two kinds of correction to speed up time setting when the difference between the exact time and that displayed by the watch is great.

A rough time setting is performed by rotating stem 2 slowly in one direction or the other depending on whether the watch is to be put forward or put back. A modification of the hours indication is performed by subjecting the stem to one or more rapid rotations, each rotation causing the number of hours displayed to increase or to decrease by one unit. In both cases, the flashing action of the display is interrupted during correction.

Throughout the time stem 2 is in outer position II, the seconds indication progresses in a normal way.

If, after having performed a change of hour only, stem 2 is returned to neutral position I, the watch immediately starts working normally again.

If, on the other hand, the same operation is performed after simply pulling out stem 2 without rotating it or after having made a rough time setting with or without a change of hour, the watch then switches automatically and for a set time, e.g. about one minute, to a mode enabling, if required, the seconds to be reset to zero.

From the outside, the only noticeable difference between this mode and the normal operating mode is that the seconds display flashes while otherwise progressing normally.

If, during the set time of about one minute, a more or less short pressure is applied to stem 2 to move it temporarily into position III, the seconds display is then effectively reset to zero and the watch switches immediately back to the normal operating mode. And if, just before depressing stem 2, the watch displays over thirty seconds, the minutes indication is incremented by one unit.

On the other hand, if the stem is not depressed before the end of the one minute period, the watch then switches back automatically to normal operation, without modifying the seconds indication.

In all cases, from the moment the watch has started to operate normally again any pressure or new pressure on the stem remains of course ineffective.

Providing such a transitory mode for resetting the seconds to zero, except in the case of a change of hour done when it is not really justified, turns out to be a very neat and simple way of solving the problem: although the watch has only one control member, in this case a time setting stem, the user can, at will, perform a fine time setting only, by acting on the seconds alone, or a rough time setting only, or both together, i.e. a complete time setting.

Since the seconds display is neither stopped nor reset to zero as long as stem 2 is not moved to position III, in the cases where the above transitory mode is provided, the chances of the user accidentally losing the exact time are practically eliminated since for this he would have to perform two false moves in succession.

For example, if the user inadvertently pulls the stem out without intending to perform any kind of correction, he will obviously take care to return it to the neutral position I and not to depress it completely.

Another example: if, when wanting to perform a change of hour only, the user modifies the minutes indication by unwittingly rotating the stem slightly after having pulled it out or by rotating it intentionally but too slowly, it will then be a simple matter for him to readjust the watch, possible bearing in mind the fact that the seconds display may in the meantime have gone through zero. There again, he should take care to move stem 2 back to position I after having performed the required change in hour indication.

There remains the possibility of the wearer, after having made a correction, depressing stem 2 too far, causing it to move from position II to position III, before letting it return to normal position I. If the correction consists only in a modification of the hour alone, there is no risk since, in this case, the transitory mode is not involved. If, however, the correction consists in a rough time setting, it does not matter if the seconds are reset to zero, even though the wearer did not want this, since the minutes were wrong already.

But, if the possibility of an unintentional resetting of the seconds to zero is to be totally eliminated, it is a simple matter to provide the watch with means for inhibiting the influence of a pressure on stem 2 for one second or more after it has been moved from position II back to position I or with a time delay device such as that described in Swiss Patent Specification No. 608933, wherein pressure exerted on a control member, in this case a push-button, only becomes effective if it is kept up for a sufficient length of time, e.g. more than one second. Such means can easily be added to an electronic circuit such as that shown in FIG. 2 which will now be described.

This circuit comprises a time base 3, e.g. a quartz oscillator, for generating a standard frequency signal of e.g. 32768 Hz. This signal is applied to the input of a frequency divider 4 made up of a plurality of flip-flops connected in series and which issues on its output a time pulse signal having a frequency of 1 Hz.

The output of divider 4 is connected to a counting input CL of a seconds counter 5 which also has a reset input R, a multiple state output $Q_1$ which issues a plurality of binary signals permanently indicating the contents of the counter, and a single counting output $Q_2$ which issues a pulse every time the counter is completely filled.

The output $Q_2$ of counter 5 is connected via a time delay circuit 6 (whose function will be described later) and via an OR gate 7 to the counting input CL of a minutes counter 8 having a counting output $Q_2$ which is in turn connected to the counting input CL of an hours counter 9. Counters 8 and 9 have state outputs $Q_1$ similar to that of seconds counter 5. Further, counters 8 and 9 are reversible and therefore have each an input C/D for receiving a logic signal whose level will determine whether the counting is forward or backward. It is assumed that every time one of these counters receives a pulse on its counting input CL, its content is incremented by one unit if the signal is high and decremented by one unit if the signal is low.

The state outputs $Q_1$ of counters 5, 8 and 9 are respectively connected to inputs a, b, c of a circuit 10 which, via a multiple output f, controls display unit 1 of the watch.

Display control circuit 10 is quite conventional and may merely consist of a decoder and of the means which, in response to the 1 Hz signal generated by divider 4 and to a control signal applied respectively to a fourth input, d, and a fifth input, e, of the circuit, cause the characters indicating the hours and the minutes or those indicating the seconds, to flash at the required times. The control signal is of course not single but is made up of at least two elementary logic signals since, for flashing purposes, there are three possible states for unit 1, one being the complete absence of flashing.

Figure 2:
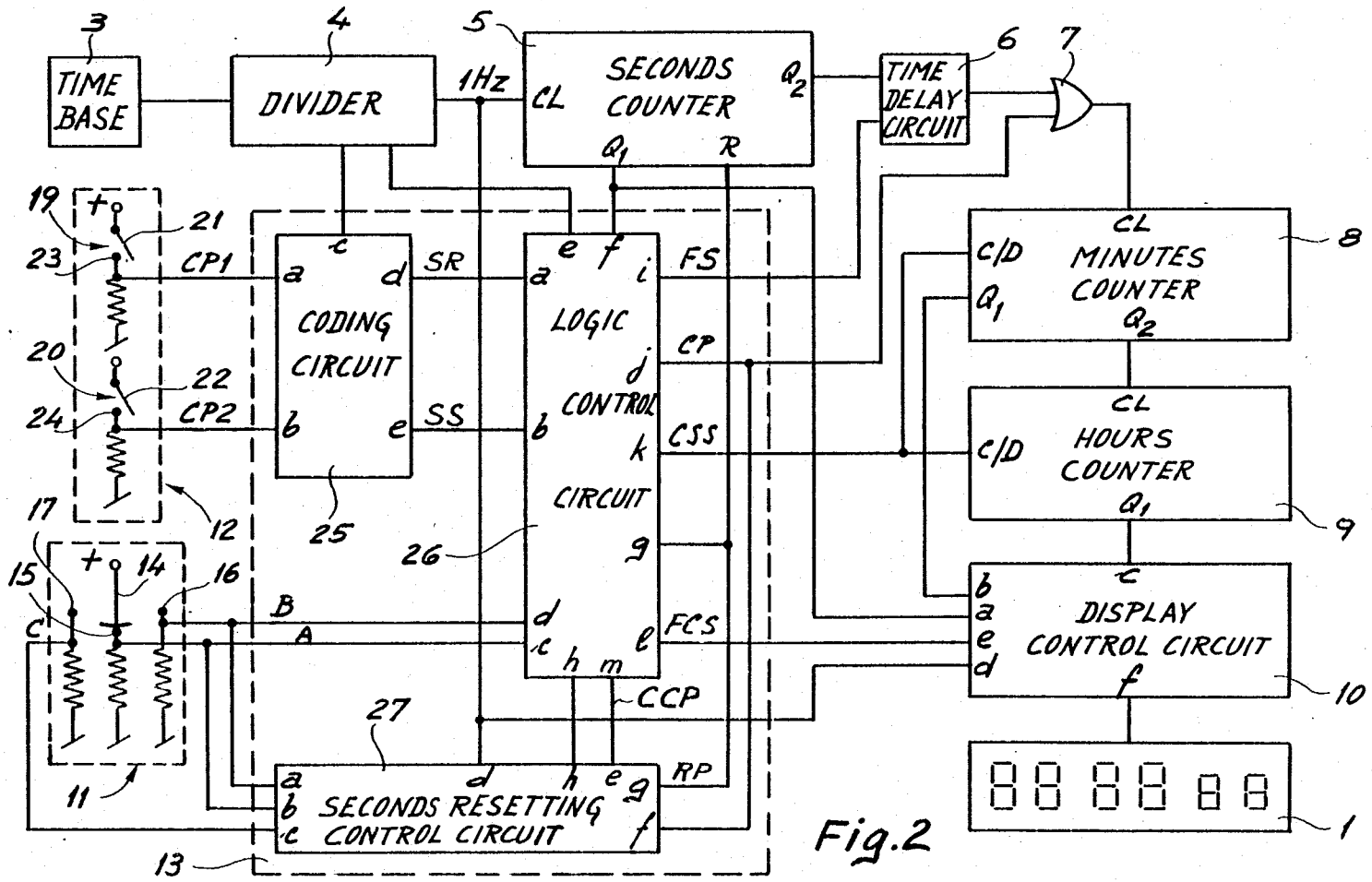
FIG. 2 is a block diagram of a circuit with which the watch of FIG. 1 may be provided.

The FIG. 2 circuit comprises also a switching device 11 for generating signals that indicate at all times the axial position of time setting stem 2, a switching device 12 for generating signals representative of the rotational movements of stem 2, independently of its position, and a correction circuit 13 which generates, in response to inter alia these switching signals, other signals which, when applied to counters 5, 8 and 9, to gates 6 and 7 and to display control circuit 10, either enable the watch to operate normally or enable the various corrections mentioned above to be carried out.

Switching device 11 includes a conductive member 14 coupled mechanically to stem 2 and connected to the positive terminal of the watch voltage supply, and three fixed contacts 15, 16 and 17, each connected via a resistor to ground, i.e. to the negative terminal of the voltage source. Depending on whether stem 2 is in neutral position I, outer position II or inner position III, conductive member 14 respectively engages contact 15, 16 or 17 and raises the latter to the voltage of the positive pole of the source. Thus, on each contact there appears a signal A, B or C which is high (level "1") when the contact is engaged by member 14 and which is low (level "0") in the opposite case.

Switching device 12 includes switches 19 and 20 each comprising an elastic, electrically conductive, blade 21, respectively 22, having one end that is fixed and connected to the positive terminal of the voltage source and whose other end may be alternately applied against and removed from a fixed contact 23, respectively 24, connected to ground via a resistor. When stem 2 is rotated in one direction or the other, these switches are actuated by means not shown to generate two signals CP1 and CP2. Signals CP1 and CP2 are made up each of a series of pulses having a frequency proportional to the rotational speed of stem 2 and which are out of phase with respect to each other, the sign of the phase difference depending on the direction of rotation. The above actuation means may for instance be those described in Swiss Patent Specification No. 632894, i.e. two elliptic cams borne by and centered on stem 2, with their major axes forming between themselves an angle of about 45°.

As mentioned earlier, switching device 12 is designed to operate in any axial position of stem 2. Correction circuit 13 must therefore include means for inhibiting the effects of signals which may be generated when stem 2 is not in outer position II. A system could of course be envisaged in which the switches are actuated only when stem 2 is in position II, but it is likely to be more difficult to achieve from a mechanical point of view and less reliable than the other.

Correction circuit 13 comprises a circuit 25 for coding the rotational movements of stem 2, a logic control circuit 26 and a control circuit 27 for resetting the seconds to zero.

Coding circuit 25 has two inputs a and b connected to the fixed contacts 23 and 24 of switching device 12 and receives on a third input c a periodic signal of say 256 Hz, off the output of an intermediate stage of frequency divider 4. Circuit 25 is similar to the coding circuit described in Swiss Patent Specification No. 632894 and is mainly made up of flip-flops and gates. It first rids the switching pulses generated by switches 19 and 20 of accompanying interference signals due to bouncing of blades 21 and 22 on fixed contacts 23 and 24. Circuit 25 then generates from the switching pulses a signal SR also made up of pulses whose number and frequency are proportional to, respectivley, the angle and the rotational speed of the stem, and a signal SS representative of the direction of rotation.

When stem 2 rotates in any axial position in a direction which, in the correction mode, enables the watch to be put forward, signal SS goes high and remains high as long as stem 2 is not rotated in the opposite direction. When this occurs, signal SS goes low and so on.

As for pulses of signal SR, eight are generated for each complete turn of stem 2.

Signals SR and SS issue from outputs d and e of coding circuit 25 and are applied to inputs a and b of logic circuit 26.

Circuit 26 has a further pair of inputs, c and d, that are respectively connected to fixed contacts 15 and 16 of the switching device 11. A fifth, multiple, input, e, receives various periodic signals that are issued by the outputs of certain intermediate stages of frequency divider 4 and that are required by the circuit for processing the other signals it receives and for generating the signals it issues. A sixth, multiple, input, f, is connected to the state output $Q_1$ of seconds counter 5. Two more inputs, g and h, are provided, one for receiving the pulse which, as will be shown later, is generated by control circuit 27 for resetting the seconds to zero when the user actually does perform a fine time setting during the set time at his disposal, and the other for receiving a pulse that is generated by circuit 27 also, at the end of the set time when no such correction is performed.

Control circuit 26 further has five outputs i, j, k, l and m. Output i issues a logic signal FS which keeps the same value, e.g. "1", except during the periods when, as will be shown later, high frequency pulses are applied to minutes counter 8 to modify the display by a whole hour, in which case it goes low. Signal FS is applied to one input of time delay circuit 6 which receives on another input the pulses issuing from the counting output $Q_2$ of seconds counter 5. The output of circuit 6 is connected to a first input of OR gate 7. The function of circuit 6 is to memorize a pulse received from counter 5 if this pulse is generated while signal FS is low and then to allow this pulse to proceed to its output as soon as signal FS goes high again. Otherwise, it would simply transmit the pulses from the counter to gate 7 as soon as it receives them. It may be embodied, e.g., in the same manner as in U.S. Patent Specification No. 4,398,831 and operate with a periodic signal having the same frequency as the pulses which enable the hour display to be corrected, this signal being received from frequency divider 4 via a connection not shown.

Output j of control circuit 26 is connected to a second input of OR gate 7 and issues correction pulses CP which circuit 26 also generates. These pulses are all equal. Only their number differs depending on the type of correction performed.

Outputs k and l of circuit 26 issue signals CSS and FCS which respectively control the direction of the count in counters 8 and 9 and the flashing of the characters in display unit 1. Thus, output k is connected to inputs C/D of counters 8 and 9 and output 1 is connected to input 4 of display control circuit 10. The nature of signals CSS and FCS has already been given without them having been identified. It is therefore not necessary to discuss this again here. It should however be noted that, unlike signal SS generated by coding circuit 25, signal CSS is always high except when stem 2 is both in its outer position and rotated in a direction enabling the watch to be put back.

Output m provides outside logic circuit 26 a signal CCP made up of correction control pulses which are intermediaries between signal SR generated by circuit 25 and correction pulses CP. The purpose of signal CCP will become apparent later.

Since the design of logic circuit 26 is unrelated to the invention, there is no need to describe this circuit in detail. Further, it is known to set a watch to the right time or to change the hour alone by rotating a stem at low or high speed in the same axial position, and to increment the minutes indication by one unit when the seconds are being reset to zero at a time when the watch displays more than thirty seconds. Moreover, it is commonplace in digital watches for characters of the display unit to be made to flash to indicate that the watch is in a correction mode and to show which information can then be modified. Circuit 12 simply enables all three operations to be performed at the same time. It is thus a simple matter for a man of art to produce such a circuit by using circuits of known watches.

Control circuit 27 for resetting the seconds to zero, of which one form of embodiment is described later, comprises six inputs, a to f, and two outputs, g and h. Inputs a, b and c are respectively connected to the fixed contacts of switching device 11 and inputs d, e and f respectively receive the 1 Hz periodic signal generated by frequency divider 4, correction control pulses CCP issuing from output m of control circuit 26 and correction pulses CP issuing from output j of circuit 26. As for the outputs, output g is connected both to the zero resetting input R of seconds counter 5 and to the input g of logic control circuit 26, and output h is connected to input h of circuit 26.

The FIG. 2 circuit operates as follows:

When time setting stem 2 is in neutral position 1 (see FIG. 1), conductive member 14 of switching device 11 engages fixed contact 15. Signals A, B and C generated by device 11 are therefore respectively high, low and low.

Most of the time, when stem 2 is in that position, the watch is in the normal operating mode.

In this case, signal FS which is applied to time delay circuit 6 and signal CSS which controls the direction of the counting are high. The pulses appearing on the counting output $Q_2$ of seconds counter 5 are thus transmitted as soon as they are generated to counter 8 whose content increases by one unit every minute, while the pulses generated every hour by counter 8 in turn increment the content of counter 9. Further, the elementary signals making up signal FCS which is applied to the input e of display control circuit 10 are then at logic levels such that display unit 1 indicates the state of counters 5, 8 and 9 without the figures flashing.

Of course, as long as the watch operates normally, no pulse issues either from the outputs j and m of logic circuit 26 or from the outputs g and h of control circuit 27 for resetting the seconds to zero. If stem 2 rotates, pulses SR issue from the output d of coding circuit 25, in response to switching pulses CP1 and CP2 generated by switches 19 and 20, but they remain blocked within logic circuit 26. Moreover, the latter does not take into consideration, at that instant, the logic level of rotational direction signal SS generated by circuit 12, for the generation of signal CSS. As for control circuit 27, it remains at rest.

If, while the watch is operating in this manner, stem 2 is depressed into position III, the logic levels of signals A and C generated by switching device 11 are inverted, but this does not affect the overall operation of the remainder of the circuit. The same applies when stem 2 later returns automatically to neutral position I.

If stem 2, instead of being depressed into position III, is pulled into position II, it is no longer signal C of switching device 11 that goes high, but signal B. Logic control circuit 26 immediately reacts by modifying the signal FCS that it issues on its output 1 whereby control circuit 10 causes the hours and minutes display to flash by using the 1 Hz signal that is applied to its input d. Circuit 26 also readies itself to process any pulses SR it may subsequently receive on its input a, instead of blocking them. It however maintains both signal FS and signal CSS for controlling the counting direction high, even if rotational direction signal SS is then low, which means that, apart from the fact it is flashing, the display of the minutes and of the hours continues, as that of the seconds, to proceed normally as long as stem 2 is not touched.

If stem 2 is rotated in the direction of forward setting of the watch, signal SS goes high, if it is not high already, and the level of signal CSS remains unchanged. Further, logic circuit 26 starts by counting for a set time, e.g. 60 ms or so, the first pulses SR it receives from coding circuit 25. If it counts say more than three pulses, it infers that stem 2 is being rotated rapidly and that the correction to be made is a change of the hour alone. It then generates a correction control pulse CCP which causes sixty correction pulses CP to be formed. These pulses CP of relatively high frequency, e.g. 64 Hz, issue from output j of the circuit and are transmitted via OR gate 7 to the counting input CL of counter 8. Each pulse received by counter 8 of course causes its contents to increase, but at the end of the sixty pulses, it switches back to the value it had initially. But in the process the contents of counter 9 are incremented by one unit. In display device 1, this has the effect of causing the minutes display to progress rapidly, finally to resume the value it had to start with, and of causing the hours indication to increase by one unit when the minutes indication changes from 59 to 00.

Also at the same time as it feeds the first of pulses CP to counter 8, logic circuit 26 causes signal FS to go low only to cause it to go high again when the last pulse has been issued. Thus, if during that time a pulse appears on the counting output $Q_2$ of seconds counter 5, time delay circuit 6 retains it for a short while in its memory, in order to transmit it to minutes counter 8 immediately after signal FS goes high again, thereby making it possible always to maintain the exact time.

If after having pulled stem 2, the latter is rotated at the same speed, but in a direction enabling the watch to be put back, everything obviously happens as before except that signal SS goes low if it was not low already, that the level of signal CSS also goes low while logic circuit 26 is generating the sixty correction pulses CP, that counters 8 and 9 then deduct the pulses they receive and that, therefore, the display is not increased but is decreased by one hour.

In both cases, i.e. in either direction of rotation of stem 2, and throughout generation of correction pulses by logic circuit 26, signal FCS is such that the hours and minutes display ceases to flash.

If, however, logic circuit 26 counts, during the discrimination period of about 60 ms, only three pulses SR or less, it knows that the correction to be performed is a simple time setting and once this period is over it generates, in response to every pulse SR it receives, a correction control pulse CCP which, in turn, causes a correction pulse CP to be formed, as long as stem 2 continues to rotate.

Circuit 26 could of course also be designed to generate only one pulse for every two, or even more, pulses SR it receives, the division occurring with the generation of pulses CCP or later.

In this case, correction pulses CP, whose frequency and number are no longer fixed but are respectively proportional to the speed of rotation of stem 2 and to the angle by which the latter is shifted after the discrimination period has ended, enable the contents of counter 8 and possibly, by way of consequence, the contents of counter 9 to be modified at will.

Signal FS is always kept high because it matters not that a pulse coming from seconds counter 5 should be added to correction pulses CP.

As for the direction of the correction and the flashing of the display, all takes place as with a change of hour alone.

In fact, since coding circuit 25 only generates eight pulses SR per revolution of stem 2, the display cannot of course be modified by more than a few minutes without stopping the turning of stem 2. Frequently, because of the accuracy of quartz watches, this may be sufficient to perform a rough time setting. However, far more substantial corrections are sometimes required. When such is the case, if stem 2 can be turned several times without interruptions of more than say half a second between actuations, at the moment of the second and following rotations, control circuit 26 continues to generate a correction pulse in response to every pulse SR. Otherwise, it again starts to count, at the beginning of each new actuation, the first pulses it receives.

It should be noted that this discrimination phase, which is necessary if the circuit of the watch is to know whether the correction to be performed is a change of hour alone or a simple time resetting operation, also provides a measure of security: if after having pulled stem 2 the latter is unwittingly rotated, pulses SR could be generated by coding circuit 25 but the chances of them being sufficient in number to initiate the formation of a correction control pulse are practically nil.

As for control circuit 27 for resetting the seconds to zero, pulling stem 2 into position II causes it to leave its rest state. If stem 2 is then rotated rapidly to bring about a change of hour only, input e of circuit 27 then receives correction control pulse CCP generated by logic circuit 26, but this pulse has no effect on its operation. However, it counts the correction pulse CP received on its input f and, on receiving the sixtieth, it returns automatically to its rest state without having issued a signal. If stem 2 is again rotated in the same manner, the pulse CCP that is generated reactivates the circuit which enables it then to count the new correction pulses and to return to the rest state.

Thus, if stem 2 is returned to neutral position I after having only modified the display by one or more complete hours, the watch resumes normal operation, and if stem 2 is then depressed to move it to position III, this action is of no consequence.

But if stem 2, after having been pulled, is rotated slowly one or more times, there are then two possibilities. If the modification of the display is less than one hour, none of the correction control pulses fed to zero-seconds resetting control circuit 27 has any effect on its operation and as it counts less than sixty correction pulses it remains active. But if the correction is greater than one hour, the sixtieth correction pulse CP received by circuit 27 causes it to return to its rest state but the sixty-first correction control pulse CCP applied to its input e reactivates it and it again starts counting the correction pulses from zero. Thus, everything occurs as though it has counted less than sixty pulses CP and here again it remains active.

The same would of course apply if one or several hour changes only were first performed followed by a rough time setting.

In these various cases, as soon as stem 2 is returned to neutral position I, zero-seconds resetting control circuit 27 starts counting the 1 Hz pulses it receives on its input d whereas logic circuit 26 causes the seconds indication to flash, instead of the hours and minutes indications.

If no pressure is exerted on stem 2 before circuit 27 has counted sixty 1 Hz pulses, the latter then feeds via its output h to control circuit 26 a pulse that causes the flashing of the seconds indication, which has been progressing normally ever since stem 2 was pulled, to cease. Further, as it issues this pulse, circuit 27 automatically returns to its rest state. From then on the watch operates normally again.

If, however, circuit 27 detects an inversion of the logic level between signals A and C due to pressure being exerted on stem 2 before having counted sixty 1 Hz pulses, it generates as soon as this chance occurs a pulse no longer on its output h but on its output g, as it returns to its rest position. This pulse, referenced RP, is received both by seconds counter 5, whose contents are immediately reset to zero, and by logic circuit 26 which immediately modifies signal FCS to cause the flashing of the seconds display to stop and which, as it knows the contents of counter 5 just before it was reset to zero, issues a correction pulse CP to minutes counter 8 if said contents exceed thirty.

When it does get generated, pulse CP is of course also sent to zero-seconds resetting control circuit 27 but it is easy to avoid this pulse being taken into consideration by providing blocking means in circuit 27, or as will be shown later, by ensuring that the counter, which circuit 27 necessarily comprises for counting the pulses applied to its input f, is reset to zero when stem 2 is pulled into its outer position.

There remains the case of stem 2 being moved into position II to perform a zero-seconds resetting operation only. Everything happens as with a rough time setting, except that no correction pulse CP is generated. Despite this, circuit 27 remains operative when stem 2 is returned to neutral position I and the zero resetting operation is performed in the same way as after a minutes correction.

Figure 3:
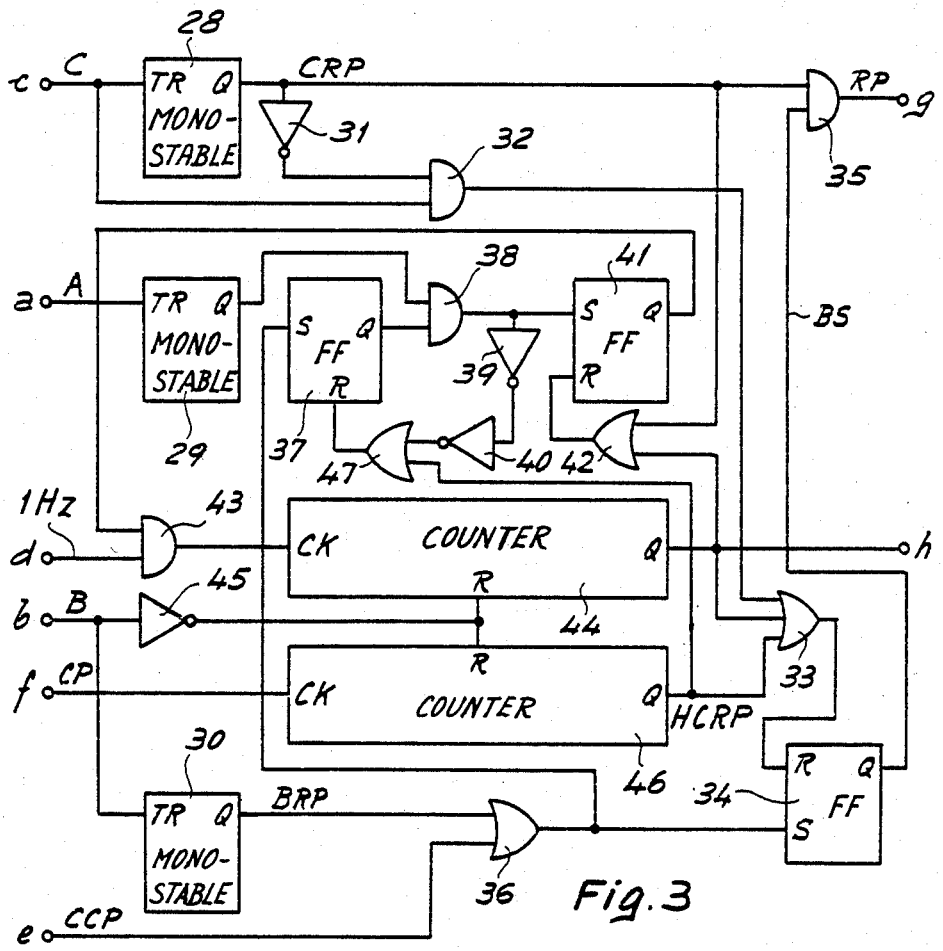
FIG. 3 is a detailed diagram showing one possible form of embodiment of a zero-seconds resetting circuit used in FIG. 2.

FIG. 3 shows a possible form of embodiment for zero-seconds resetting control circuit 27.

In this form of embodiment, the circuit comprises three identical monostable circuits 28, 29 and 30 whose inputs TR are connected respectively to inputs c, a, and b of circuit 27, which inputs receive signals C, A and B generated by switching device 11 (FIG. 2).

Output Q of monostable circuit 28 associated with input c is connected via an inverter 31 to a first input of an AND gate 32 whose second input is connected directly to circuit input c of circuit 27 and whose output is linked to a first input of a three-input OR gate 33.

The output of OR gate 33 is connected to the reset input R of an RS flip-flop 34 made up in the conventional way of two NOR gates not shown and whose output Q is connected to one of the two inputs of an AND gate 35, the other input of this gate being connected to the output Q of monostable circuit 28 and its output being connected to the output g of circuit 27. Set input S of flip-flop 34 is in turn connected to the output of an OR gate 36 having one input connected to output Q of monostable circuit 30, its other input receiving correction control pulses CCP when the latter are applied to input e of circuit 27.

The output of OR gate 36 is also connected to set input S of another RS type flip-flop 37 whose output Q is connected to one input of an AND gate 38 and whose reset input R is connected to the output of gate 38 via two inverters 39 and 40 and a two-input OR gate 47.

AND gate 38, whose other input is connected to output Q of monostable circuit 29, has its output also connected to the set input S of a third flip-flop 41 of the same type as the other two and whose reset input R is connected, via a two-input OR gate 42, to output Q of monostable circuit 28.

Output Q of flip-flop 41 is connected to one input of an AND gate 43 which receives on its other input the 1 Hz signal that is applied to input d of circuit 27 and whose output is connected to the counting input CK of a counter by sixty 44.

Reset input R of counter 44 is connected to input b of circuit 27 via an inverter 45 and its counting output Q is connected to a second input of OR gate 33, to the input of OR gate 42 that is not connected to the output of monostable circuit 28, and to output h of circuit 27.

Circuit 27 further comprises another counter by sixty, 46, adapted directly to receive, on its counting input CK, correction pulses CP when they are received on circuit input f. Reset input R of counter 46 is also connected to the output of inverter 45 and output Q of counter 46 is connected to a third input of OR gate 33 and to the input of OR gate 47 that is not connected to the output of inverter 40.

The signal diagrams of FIGS. 4*a* to 4*d* will help to understand the operation of circuit 27 which will now be described.

These diagrams show the signals which appear with time at various points of circuit 27 when a fine time setting (FIG. 4*a*), a correction of both the minutes and the seconds (FIG. 4*b*), a change of the hour indication alone by one hour (FIG. 4*c*), or a complete time setting starting with a change of the hour indication alone (FIG. 4*d*), are performed. There are of course other possibilities, some of which have already been considered, such as the non-performance of a zero-seconds resetting operation after a correction of the minutes.

Each signal diagram shows signals B, C, CCP, CP and RP, which are input and output signals discussed earlier, and signals BRP, CRP, HCRP and BS which are internal to the circuit and which appear on the outputs of monostable circuit 30 and 28, counter 46 and flip-flop 34, respectively.

As explained earlier, when the watch operates normally, signals A, B, C which are applied to inputs a, b and c of circuit 27 and which are generated by fixed contacts 14, 15 and 16 of switching device 11 (FIG. 2) are respectively high, low and low and circuit 27 is in a state of rest. Outputs Q of monostable circuits 28 to 30 and of flip-flops 34, 37 and 41 are then all low. 1 Hz pulses do appear on input d of circuit 27 but are blocked by AND gate 43 since the output of flip-flop 41 is low. The contents of counters 44 and 46 depend on the last correction that was made.

When stem 2 is moved to position II, signal A goes low and signal B goes high. As monostable circuit 29 is designed only to react to the rising edge of a signal, its output Q remains low. But output Q of monostable circuit 30 goes high, remains so briefly, e.g. for 7.8 ms, then automatically goes low again. Pulse BRP thus generated is transmitted to set inputs S of flip-flops 34 and 37 via OR gate 36. Outputs Q of flip-flops 34 and 37 thus go high, thereby opening AND gates 35 and 38. Further, when signal B goes high, reset inputs R of counters 44 and 46 go low and their contents are reset to zero if not already so.

If stem 2 is then returned to neutral position I without a change of hour alone or a rough time setting having been performed, it is monostable circuit 29 which issues a pulse similar to that generated earlier by circuit 30. This pulse is transmitted by AND gate 38 until flip-flop 37 reacts to the change in level of the output of gate 38 by making its output Q go low again. Inverters 39 and 40 slightly delay the closure of gate 38 again, i.e. slightly lengthen the pulse which appears on its output. These inverters could possibly be dispensed with.

The pulse issuing from AND gate 38 and transmitted to the set input S of flip-flop 41 causes its output Q to go high and, therefore, AND gate 43 to open. Counter 44 then begins to count the 1 Hz pulses it receives on its input CK.

As long as counter 44 has not counted sixty pulses, which corresponds roughly to one minute, its output remains low and it is only when it receives the sixtieth pulse that it will itself emit a pulse, zeroing its contents in so doing.

Figure 4A:
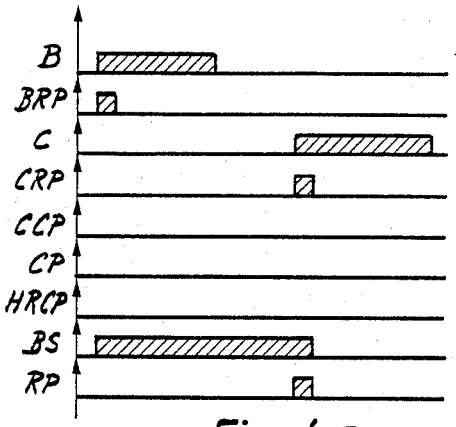
FIGS. 4*a* to 4*d* are signal diagrams illustrating the operation of the FIG. 3 circuit in a variety of possible situations.
Figure 4B:
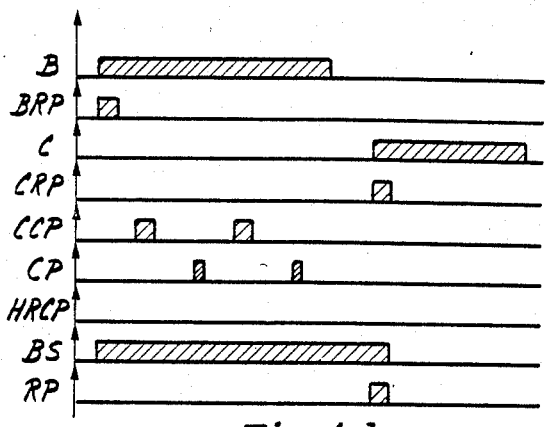
Figure 4C:
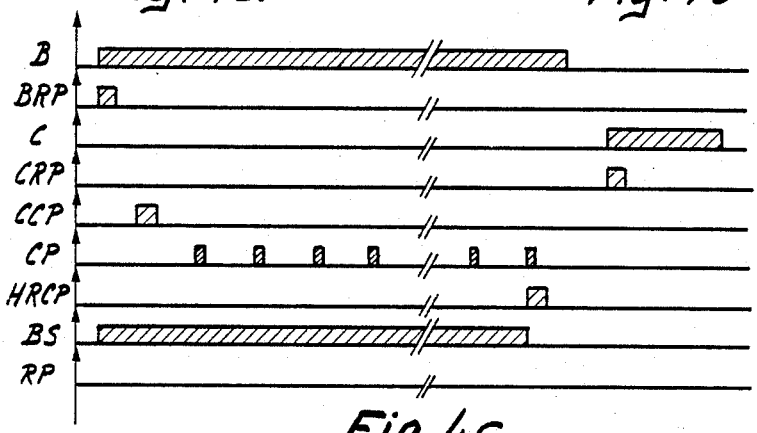

If, before counter 44 generates this pulse, pressure is exerted on stem 2, the situation will be that shown in the FIG. 4*a* diagram. Signal C goes high, whereupon monostable circuit 28 generates a pulse CRP, identical to pulse BRP mentioned earlier. As AND gate 35 is then open, pulse CRP reaches output g of circuit 27 and then becomes pulse RP which enables seconds counter 5 of the watch to be reset to zero. Also, when signal C and output Q of monostable circuit 28 go high, the input of AND gate 32 which is connected to input c of circuit 27 also of course goes high, while its other input goes low. Furthermore, as shown by the diagrams of FIGS. 4*a* to 4*c*, even if the pressure exerted on stem 2 is very brief, its duration still remains far greater than that of pulse CRP generated by monostable circuit 28. Therefore, at the end of this pulse, the input of AND gate 38 that is connected to inverter 31 goes high again while the other input is still high, the latter only going low again when the pressure is stopped. A pulse is thus obtained on the output of gate 38, which starts when pulse CRP ends and which ends when signal c goes low again. Since flip-flop 34 reacts to the rising edge of pulses applied to its inputs, its output Q goes low again when pulse CRP has gone through AND gate 38 to again close the latter.

Another consequence of the pressure exerted on stem 2 is that, when output Q of monostable circuit 28 goes high, output Q of flip-flop 41 goes low again, and that AND gate 43 then ceases to transmit to counter 44 the 1 Hz pulses that are applied to input d of circuit 27.

When stem 2 later returns to neutral position I, monostable circuit 29 again generates a pulse, but since flip-flop 37 is low, this pulse is blocked by AND gate 38.

But if stem 2 is not depressed before counter 44 has issued a pulse on its output Q, it is this pulse which, on being transmitted via OR gates 33 and 42 to the reset inputs R of flip-flops 34 and 41 respectively, causes flip-flops 34 and 41 to go low again and gates 35 and 43 to close.

In both cases, gates 35 and 38 will of course remain closed as long as stem 2 is not pulled out to position II again. Until then, they will block all pulses generated by monostable circuits 28 and 29 in response to intentional or unintentional pressure on stem 2.

If, after being pulled out to position II, stem 2 is rotated to perform a correction of under sixty minutes, circuit 27 operates in exactly the same way as in the previous case except that, before stem 2 is returned to neutral position I, flip-flops 34 and 37 receive on their set inputs S, after pulse BRP, correction control pulses CCP which are of no effect, and that counter 46 counts the correction pulses CP resulting from pulses CCP. This is shown in the FIG. 4*b* diagram in which the resetting of the seconds to zero follows a correction of two minutes.

If, after being pulled to position II, stem 2 is rotated rapidly instead of slowly, to modify the display by a whole hour (FIG. 4*c*), flip-flops 34 and 37 only receive one correction control pulse CCP which, again, does not modify their state. Moreover, counter 46 counts the sixty correction pulses CP that are applied to its input CK and, on receiving the sixtieth, issues on its output Q a pulse HCRP, automatically zeroing its contents in so doing. Pulse HCRP is transmitted via OR gates 33 and 47 to the reset inputs R of flip-flops 34 and 37 respectively. Outputs Q of these flip-flops then go low again, thereby closing AND gates 35 and 38.

Thus, if stem 2 is then returned to neutral position II, the pulse that is then generated by monostable circuit 29 is not transmitted to input S of flip-flop 42 and the 1 Hz pulses fed to input d of circuit 27 are still blocked by AND gate 43. Further, any pressure subsequently exerted on stem 2 has of course no effect.

If, instead of returning stem 2 to position I after having performed a change of one hour only, it is again rotated rapidly, the new correction control pulse CCP received by circuit 27 causes outputs Q of flip-flops 34 and 37 to go high again and everything then occurs as if stem 2 had been turned just after having been pulled.

Figure 4D:
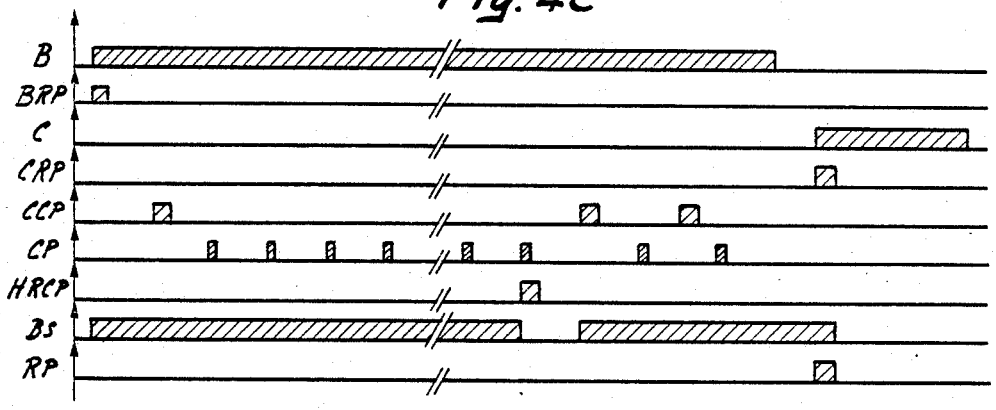

Similarly, as shown in FIG. 4*d*, if after having modified the display by one whole hour or, which amount to the same thing for circuit 27, by several hours, a correction of the minutes indication is performed, it is then the first pulse CCP that is generated after starting to turn stem 2 slowly which causes flip-flops 34 and 37 to go high again and from then on the situation is the same as if no change of the hour alone had taken place.

When the watch is corrected by more than one hour, by only slowly turning stem 2, counter 46, on receiving the sixtieth correction pulse, issues a pulse HCRP which causes the outputs of flip-flops 34 and 37 to go low, but immediately afterwards, the sixty-first pulse CCP causes them to go high again and everything happens as if this pulse CCP came from monostable circuit 30 and as if the sixty-first correction pulse were the first.

There remains one other possibility which has also not been considered in the explanation of the operation of the FIG. 1 watch circuit: that of a change of the hour preceded by a modification of the minutes indication. The reason is that, in this case, control circuit 27 for resetting the seconds to zero (FIG. 3) would not operate properly since as explained earlier, this circuit returns to its state of rest every time it has received sixty correction pulses and it occasionally needs to be reactivated by a correction control pulse. Consequently, and although it has not been stated so far, logic control circuit 26 must be designed to prevent the user from performing such a correction, e.g. by not responding to a rapid rotation of stem 2 after a modification of the minutes indication as long as stem 2 has not been returned to neutral position I, between said modification and said rotation and as long as the watch has not ceased to be in the transitory mode for resetting the seconds to zero through which it will then necessarily pass.

If such a possibility of correction has been excluded in the watch described, it is because it is of no real interest. If the time is to be set for a watch which runs very slow or very fast, something that should normally only occur when the battery is put in for the first time or is changed, it is best to start with a correction of the hours indication because if the reverse is done it may become necessary to modify again the minutes indication at the end.

However, if the user is to be afforded this possibility nonetheless this can be achieved in various ways.

First, control circuit 27 for resetting the seconds to zero can still be designed as described earlier and logic control circuit 26 can be so designed that, in the case of a change of hour alone, it does not generate one but sixty correction control pulses, each occuring before a correction pulse.

Control circuit 27 may also be modified in such a way that it may be re-activated, instead of by pulses CCP, by correction pulses CP or by other internal signals, whether or not derived from pulses CP.

Finally, circuit 27 may be so designed as to be unable to return to its rest position before stem 2 has returned to neutral position I.

In the latter two cases, logic circuit 26 no longer needs to generate correction control pulses and its design then becomes practically independent of that of control circuit 27.

The use of one or other of these alternative arrangements remains of course withing the scope of the invention.

Moreover, the latter may apply to many watches, more or less complex and more or less close in design to that described by way of example, and these watches may be of the analogue or digital type of both.

There are many alternative arrangements for the watch that has been described.

For example, not only seconds counter 5 but also a number of stages of frequency divider 4 could be reset to zero to obtain a more accurate time setting.

The circuit of the watch could be so designed that successive one-hour changes or a minutes correction after a change of hour cannot be performed without first returning stem 2 to neutral position I.

Further, to avoid the need to provide a supplementary axial position for stem 2 only for the purpose of resetting the seconds to zero, the watch could be so designed that this resetting operation could be controlled otherwise than by pressure on stem 2, e.g. by a rapid rotation of the latter in neutral position I, although an arrangement of this kind is less practical and less reliable. Many known watches, to which the invention may apply and which are less simple than that described above, already have a pluri-positional stem including an unstable depressed position for performing a timing operation, stopping an alarm, memorizing an alarm time setting, etc. This position may also be used for resetting the seconds to zero.

The invention is compatible with, for example, the following other kinds of watches:

those where a slow rotation of the stem in the outer position enables correction of both the minutes and the hours, while a rapid rotation enables some other information to be modified, e.g. a date;

those where time setting and the changing of the hours alone or the correcting of some other information are performed in an unidirectional way, i.e. forwards only, by leaving the stem in the same axial position and by rotating it in one direction or the other;

those where time setting and the correcting of some other information, e.g. a change of hour alone, are performed in a bidirectional way by rotating the stem in different axial positions;

those where the correction of the hours indication is controlled by modifying that of the minutes by more than a certain number of units, e.g. fifteen or thirty; and those where the time setting stem is replaced by some other time setting system, e.g. capacitive contact members or photo-electric sensors. In this case, the watch circuit may be best so designed that it switches automatically to the transitory mode for resetting the seconds to zero if no correction or no new correction has been made for a while and, also, that the same will happen to cause the watch to return to normal operation after a change of hour alone. This saves the user having to perform an operation that will take the watch out of the correction mode, something that is hardly conceivable when the control member is a time setting stem.

Finally, despite what has been said earlier about the singleness of the control member and its advantages, the invention is not limited to a watch or other timepiece having one control member only. There may well be several, those not intended for a rough time setting having functions other than that of enabling a fine time setting.

We Claim

1. An electronic timepiece comprising:

a time base for generating a standard frequency signal;

a frequency dividing circuit coupled to said time base for generating time pulses;

a display unit able to indicate at least the minutes and the seconds in response to said time pulses;

a manual control member; and a correction circuit which, when the control member is actuated in a first way, causes the timepiece to switch from a normal operation mode to a correction mode in which the minutes indication may be corrected by actuating the control member in a second way, wherein said correction circuit comprises a control circuit for resetting the seconds to zero which (a), in the case where the control member has only been actuated in the first way and in the case where the control member has successively been actuated in both the first and in second ways, enables the timepiece to be put in a transitory zero-seconds resetting mode for a set maximum period from the moment the timepiece ceases to be in the correction mode, and which (b) is arranged (i) instantaneously to act on the display unit so that the seconds indication is reset to zero and to cause the timepiece to switch back to the normal operation mode, when the control member is actuated in a third way before the end of said period, and (ii) to cause the timepiece to switch back to said normal operation mode only at the end of said period if the control member has not been actuated before.

2. A timepiece as in claim 1, wherein said set maximum period is about one minute.

3. A timepiece as in claim 1, arranged to enable normal progress of the seconds indication in response to said time pulses when it is in the correction mode and also when it is in said transitory mode, as long as the control member is not actuated in said third way.

4. A timepiece as in claim 1, wherein the correction circuit is adapted to act on the display unit whereby the minutes indication progresses by one unit upon the seconds indication being reset to zero if, just before the control member is actuated in the third way, said display unit was indicating more than thirty seconds.

5. A timepiece as in claim 1, wherein said display unit is adapted to display time information other than minutes and seconds and wherein said correction circuit is adapted to enable said time information to be corrected by actuating the control member in a fourth way when the timepiece is in the correction mode and adapted to cause the timepiece to switch directly from the correction mode to the normal operation mode when a correction of only said time information has been made.

6. A timepiece as in claim 5, wherein said time information is an indication of the hours.

7. A timepiece as in claim 6, wherein said control member is a rotary stem axially movable between at least a stable neutral position, a stable outer position and an unstable inner position, and wherein said first, second, third and fourth ways of actuating the control member respectively include moving the stem from the neutral position to the outer position, rotating it slowly, moving it temporarily from the neutral position to the inner position and rotating it rapidly, the timepiece ceasing to be in the correction mode when said stem moves from the outer position to the neutral position.

8. A timepiece as in claim 7, wherein said display unit comprises a seconds counter which receives the time pulses generated by the frequency divider, a minutes counter, an hours counter, digital display means and a display control circuit to cause said means to display the contents of said counters, and wherein said zero-seconds resetting control circuit is adapted to feed to the seconds counter a pulse enabling the latter to be reset to zero when pressure is exerted on the stem while the timepiece is in the zero-seconds resetting mode.

9. A timepiece as in claim 8, wherein said correction circuit is adapted to generate, in response to a slow rotation of the stem in said outer position, correction pulses whose frequency and number are a function respectively of the speed of rotation and of the angle by which the stem is rotated, and, in response to each rapid rotation of the stem in said outer position, sixty correction pulses having a frequency which is fixed and far greater than the frequency of said time pulses, said correction pulses being transmitted to said minutes counter.

10. A timepiece as in claim 9, wherein said zero-seconds resetting control circuit comprises:

first means for generating a pulse every time the stem is moved to said inner position;

an AND gate to one input of which said pulse is applied;

a flip-flop connected to another input of said AND gate, which, when the timepiece is in said normal operation mode, is in a first state causing said gate to be closed, and which, when the stem is moved to said outer position, switches to a second state causing said gate to be open;

a first counter for counting said correction pulses and issuing a first signal causing the flip-flop to return to said first state while the stem is still in said outer position, when the counted number of correction pulses is equal to sixty;

second means for generating a second signal when a pulse is generated by said first means after the stem has been moved back from said outer position to said neutral position, said second signal enabling the flip-flop to be caused to return to said first state after said pulse is transmitted from said gate to the seconds counter, when said flip-flop is still in said second state as said pulse is generated; and a second counter for counting the time pulses supplied by the frequency divider, from when the stem is moved back to the neutral position, and for generating, at the end of said set maximum period, a third signal enabling said flip-flop to be caused to return to said first state, when it is still in said second state at the end of said period.

11. A timepiece as in claim 10, wherein said correction circuit is adapted automatically to return said flip-flop to said second state after said first signal has been generated by the first counter, if more than sixty correction pulses are generated while the stem is in said outer position.

12. A timepiece as in claim 10, wherein said zero-seconds resetting control circuit further comprises means for (a) avoiding time pulses being counted by the second counter when the flip-flop is already back in said first state and the stem is returned to said neutral position and (b) interrupting the counting of said time pulses by said second counter when a pulse is generated by said first means before the end of said set maximum period.

13. A timepiece as in claim 8, wherein said transitory mode for resetting the seconds to zero is indicated by a flashing action of their display.

* * * * *